US005499702A

United States Patent [19]

Wang

[11] Patent Number: 5,499,702

[45] Date of Patent: Mar. 19, 1996

[54] RETRACTABLE HANDLE ASSEMBLY

[76] Inventor: King-Sheng Wang, No. 17, Lane 116, Ta An Gan Rd., Tachia Chen, Taichung Hsien, Taiwan

[21] Appl. No.: 319,945

[22] Filed: Oct. 7, 1994

[51] Int. Cl.[6] ..... A45C 5/14; A45C 13/26

[52] U.S. Cl. ..... 190/115; 190/18 A; 190/39; 16/115; 280/37; 280/655

[58] Field of Search ..... 190/39, 18 A, 190/115, 117; 16/112, 115; 280/37, 47.315, 47.371, 655, 655.1

[56] References Cited

U.S. PATENT DOCUMENTS

| | | | |
|---|---|---|---|
| 3,513,952 | 5/1970 | Warner, Jr. | 190/18 A X |
| 4,538,709 | 9/1985 | Williams et al. | 190/115 X |
| 4,577,877 | 3/1986 | Kassai | 280/47.371 |
| 4,979,598 | 12/1990 | Verheij et al. | 190/115 X |
| 5,161,811 | 11/1992 | Cheng | 280/655 X |
| 5,178,404 | 1/1993 | Chen | 280/655 |
| 5,308,103 | 5/1994 | Chin-Shung | 280/655 |
| 5,372,870 | 11/1994 | Marks | 190/39 X |
| 5,374,073 | 12/1994 | Hung-Hsin | 190/18 A X |
| 5,379,486 | 1/1995 | Wang | 16/115 |

FOREIGN PATENT DOCUMENTS

| | | | |
|---|---|---|---|
| 4183674 | 6/1992 | Japan | 280/655 |
| 2040236 | 8/1980 | United Kingdom | 280/655 |

*Primary Examiner*—Sue A. Weaver
*Attorney, Agent, or Firm*—Ross, Clapp, Korn & Montgomery

[57] ABSTRACT

A retractable handle assembly of a wheeled suitcase includes a handle, a receiving element, a first tube and a second tube. The handle has two legs, each leg having an inclined end formed on a distal end thereof, a slot defined in each of the legs. The receiving element has two ends, each end has a hole defined therein for the leg inserted therethrough, each of the two ends of the receiving element, a first end of the second tube and the slot of the leg have a pin extending therethrough. There is at least one resilient element disposed between the receiving element and the handle. The first tube is fixedly received in the suitcase and at least one hole is defined in a periphery thereof, the second tube is sized to be retractably received in the first tube and has an upper hole and a lower hole defined in a periphery thereof. An upper resilient element is fixedly disposed in the second tube and biases an upper stop to insert through the upper hole and the hole of the first tube, the upper resilient element having an inclined portion corresponding to the inclined end of the leg. The second tube can be extracted out from the first tube by pushing the handle downward first to bias the inclined portion of the upper resilient element by the inclined end of the leg to disengage the upper stop from the hole of the first tube.

3 Claims, 5 Drawing Sheets

RETRACTABLE HANDLE ASSEMBLY

BACKGROUND OF THE INVENTION

The present invention relates to a lugging device and, more particularly, to a lugging device of a wheeled suitcase, which is operated by firstly pushing the handle downwardly.

There are many kinds of suitcases being used for conveniently carrying clothes or goods therewith, some of them have a pair of wheels disposed to an under side thereof and an extractable lugging device received in the suitcase in order to pull the suitcase by a user who needs only to pull the lugging device out. Said lugging device is designed to have a telescopical structure and when the lugging device is in an unextracted state, there is no suitable means to control the lugging device from being pulled out, that is, the only reason through which the telescopical lugging device is kept from being extracted when the suitcase is up sidedown is the frictional force between the telescopical structure. However, such an arrangement is not a reliable design because the frictional force will be reduced after the lugging device is operated a period of time.

The present invention intends to provide a lugging device of a wheeled suitcase, which has a handle which has to be pushed down first then a tube of the lugging device is pulled out from the suitcase such that mitigates and/or obviates the above-mentioned problems.

SUMMARY OF THE INVENTION

The present invention provides a lugging device for a wheeled suitcase, which includes a handle, a receiving element, a first tube and a second tube. The handle has two legs to form an inverted-U shaped configuration, each leg having an inclined end formed on a distal end thereof, a slot defined in each of the legs. The receiving element has two ends, a hole defined in each end thereof for the leg inserting therethrough, a pin passing through each end of the receiving element and the slot of said leg. The receiving element is engaged to the handle by disposing at least one resilient element therebetween. The first tube is received in the suitcase and has a first end and a second end, a hole defined in a periphery thereof near the first end thereof and the second end thereof fixedly engaged to an bottom of said suitcase, the second tube is extractably received in the first tube and has an upper hole defined in a periphery thereof near the first end thereof, the upper hole having an upper stop inserted therethrough which is biased by an upper resilient element, the upper resilient element having an end fixed in an inner periphery of the second tube and having an inclined portion. The second tube is extracted out from the first end of the first tube by pushing the handle downward to bias the upper resilient by the inclined end of the leg to disengage the upper stop from the hole of the first tube.

It is an object of the present invention to provide a lugging device which is operated to extract a second tube out from the suitcase by pushing a handle downward in advance.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
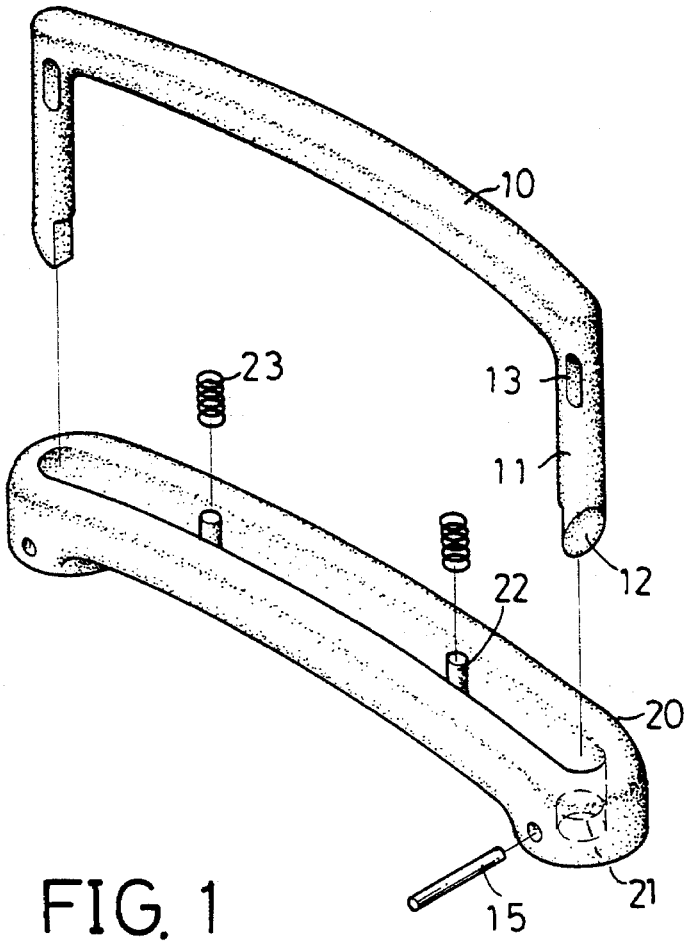
FIG. 1 is an exploded view of a handle and a receiving element of a lugging device in accordance with the present invention.
Figure 2:
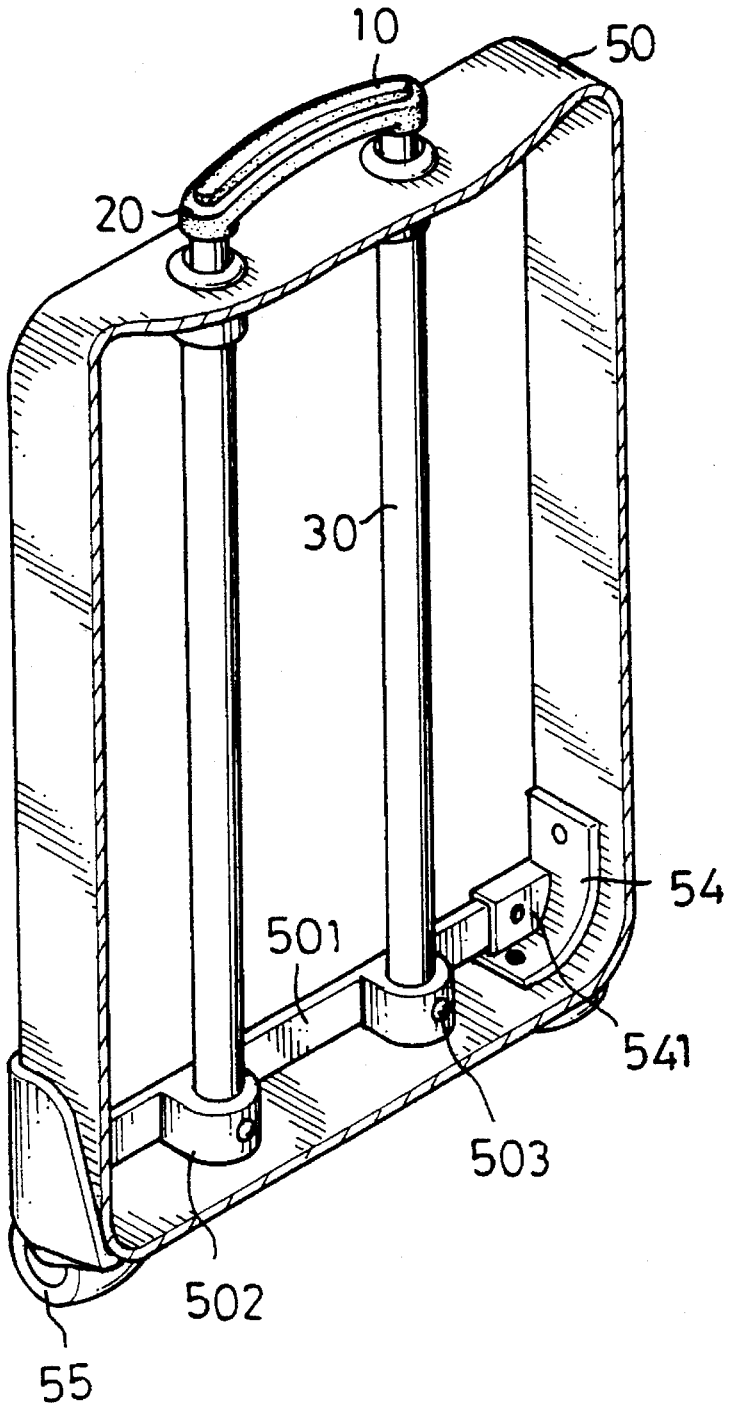
FIG. 2 is a perspective view, partially cut-away, of a suitcase in accordance with the present invention.
Figure 3:
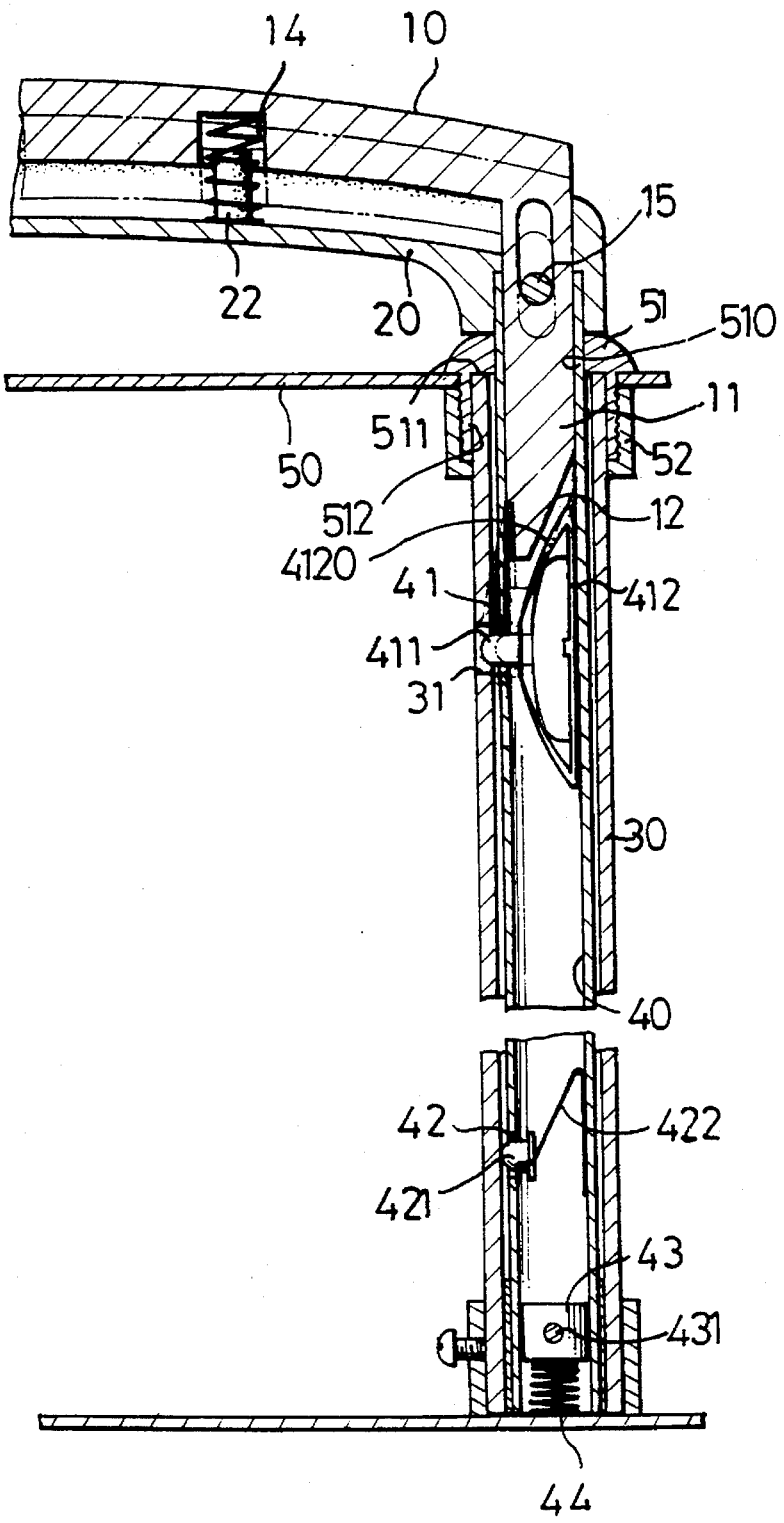
FIG. 3 is a part side elevational view, in section, of the lugging device in accordance with the present invention.

Referring to the drawings and initially to FIGS. 1 through 3, a lugging device or a retractable handle assembly of a wheeled suitcase 50 in accordance with the present invention generally includes a handle 10, a receiving element 20, a first tube 30 and a second tube 40. The handle 10 is an inverted-U shaped element and has two legs 11 extending downwardly from each end thereof, each leg 11 having an inclined end 12 formed on a distal end thereof, a slot 13 defined in each leg 11 and at least one recess 14 defined in an under side of the handle 10.

The receiving element 20 has two ends, a hole 21 defined in each end thereof, two studs 22 extending upwardly from an upper portion of the receiving element 20 and each stud 22 being in alignment with the corresponding recess 14 of the handle 10 for a resilient element 23 mounted to the stud 22 and received in the recess 14.

The suitcase 50 has two first tubes 30, each of which is fixedly disposed to two sides of the suitcase 50, each of the two sides of the suitcase 50 having a nut 51 threadedly engaged to a socket 52 fixed to the suitcase 50 and a base element 501 fixedly disposed to a bottom portion 53 of the suitcase 50, which has two receiving cups 502 extending laterally from a side thereof. The nut 51 has an upper central hole 510 defined therein and a lower central hole 512 defined in a bottom portion thereof, the lower central hole 512 having a larger diameter than that of the upper central hole 510 so as to form a shoulder portion 511 on an abutment of the upper and the lower holes 510, 512. The first tube 30 has a first end and a second end, the first end thereof received in the lower central hole 512 of the nut 51 and abutting the shoulder portion 511 and the second end of the first tube fixedly received in the corresponding receiving cup 502 by threading a bolt 503 through the receiving cup 502 and engaging against the second end of the first tube 30 and, a hole 31 defined in a periphery of the first tube 30 and near the first end thereof.

The second tube 40 has a first end and a second end and the second tube 40 is dimensioned to be retractably received in the first tube 30, an upper hole 41 defined in a periphery thereof near the first end thereof which extends through the upper central hole 510 of the nut 51 and received in the hole 21 of the receiving element 20 and the leg 11 corresponding to the first end of the second tube 40 inserted in the first end of the second tube 40, a pin 15 extending through the receiving element 20, the first end of the second tube 40 and the slot 13 of the leg 11 such that the handle 10 is restricted to move within a longitudinal length of the slot 13. The second tube 40 also includes a lower hole 42 defined in the periphery thereof near the second end thereof.

The upper hole 41 of the second tube 40 and the hole 31 of the first tube 30 in alignment with each other have an upper stop 411 inserted therethrough and the upper stop 411 is biased by an upper resilient element 412 which is compressedly fixed in an inner periphery of the second tube 40 and having an inclined portion 4120 corresponding to the inclined end 12 of the leg 11. The second end of the second tube 40 has a block 43 fixedly engaged in the inner periphery thereof by a pin 431 extending therethrough and a spring 44 which has an end fixedly engaged to the block 43 and the other end thereof contacts a bottom of the receiving cup 502 and is in a compressed state so as to provide an upward biasing force when the second tube 40 is pulled upward. The second tube 40 includes a lower stop 421 which is biased by a lower resilient element 422 which has an end fixed in the inner periphery of tube 40.

Figure 6:
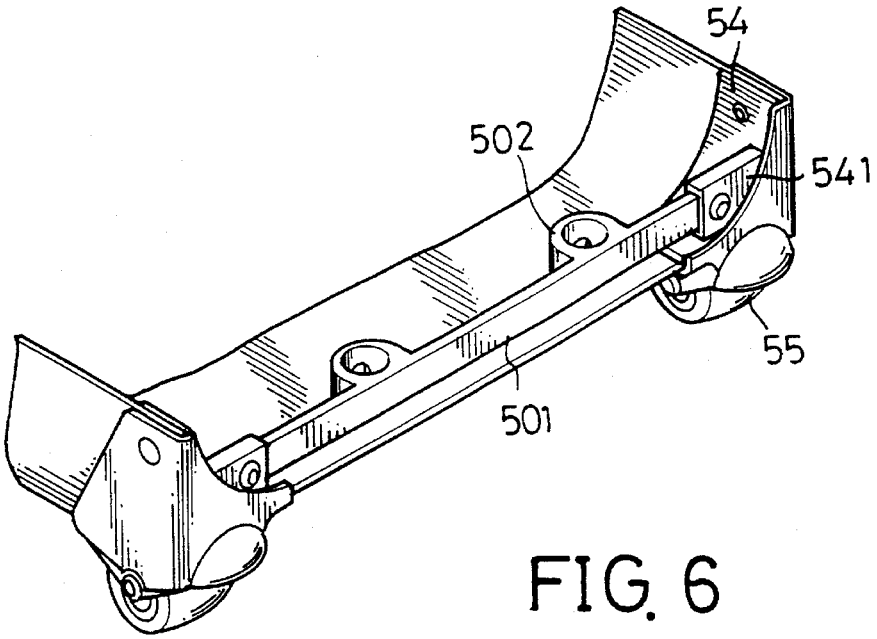
FIG. 6 is a perspective view of the bottom structure of the suitcase in accordance with the present invention.
Figure 5:
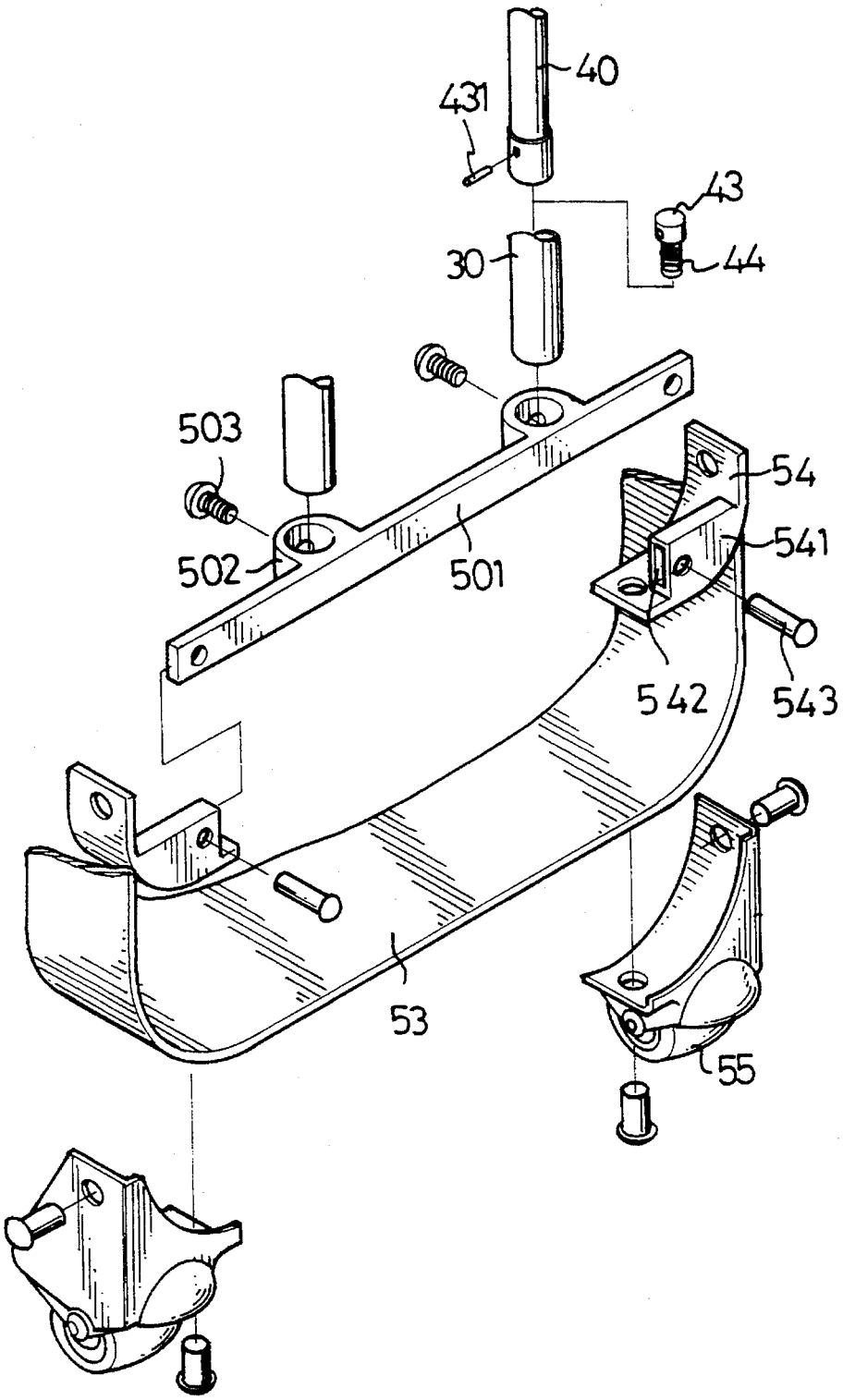
FIG. 5 is an exploded view of a bottom structure of the suitcase in accordance with the present invention.

Referring to FIGS. 5 and 6, the bottom portion 53 of the suitcase 50 has a corner element 54 disposed in each corner of both sides of the suitcase 50, the corner element 54 has a receiving portion 541 transversely extending therefrom in which a receiving hole 542 is defined and the base element 501 is fixedly received between the two receiving holes 542 of the receiving portions 541 by a rivet 543. A wheel 55 is rotatably fixed to an outer side of each corner of the bottom portion 53.

Figure 4:
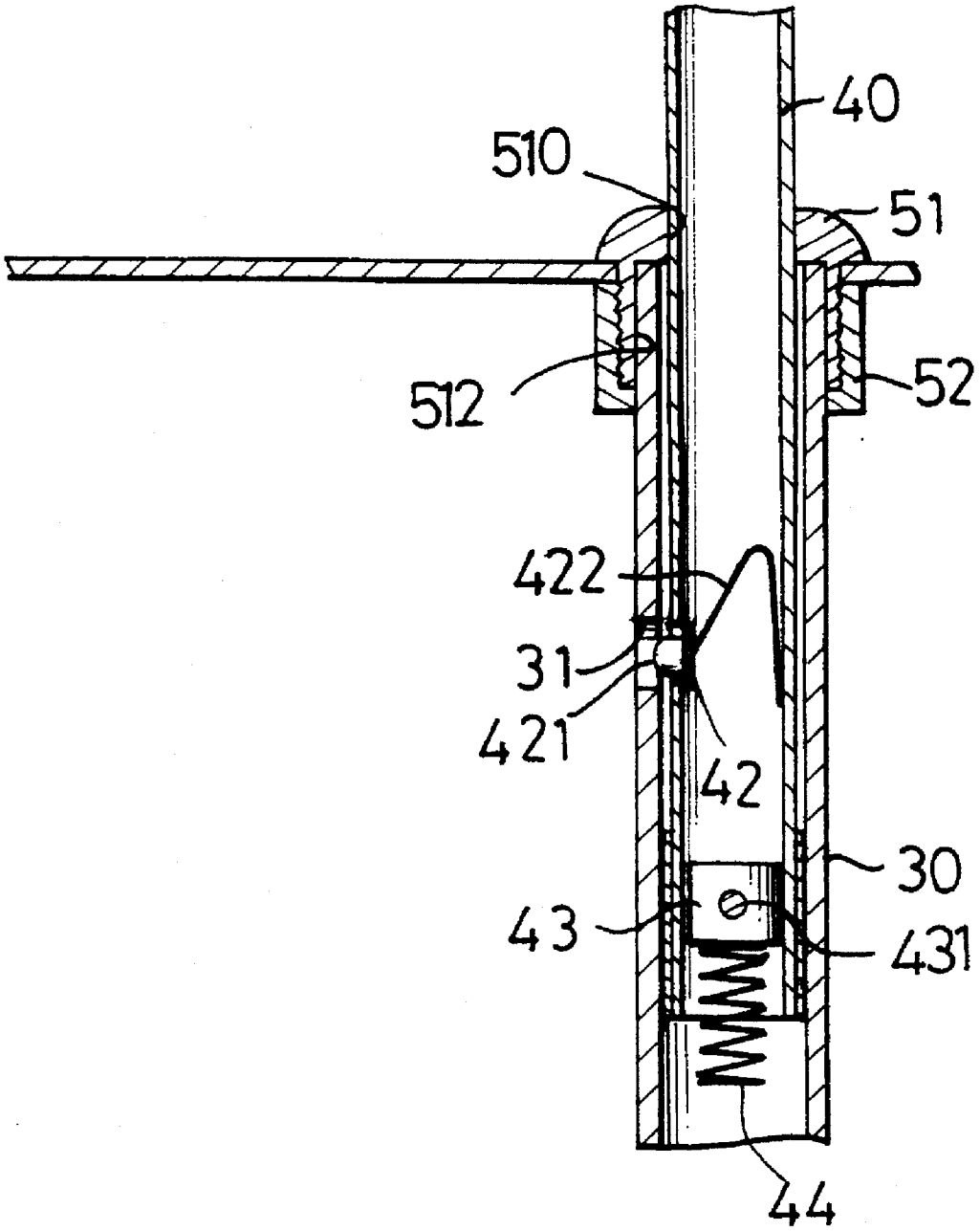
FIG. 4 is a part side elevational view, in section, of a second tube of the lugging device is extracted out from a first tube and is engaged thereto.

When the retractable handle is operated, a user holds the handle 10 and the receiving element 20 together and pushes the handle 10 downwardly such that the inclined portion 4120 of the upper resilient element 412 is pushed by the inclined end 12 of the leg 11 to bias the upper stop 411 to be withdrawn from the hole 31 of the first tube 30, and then pulls the handle 10 and the receiving element 20 upwardly, the second tube 40, the handle 10 and the receiving element 20 are extracted from the first end of the first tube 30 until the lower stop 421 is biased to be inserted in the hole 31 of the first tube 30 (FIG. 4). It is noted that the lower stop 421 is shorter than the upper stop 411 (not shown) in a longitudinal length thereof and has a rounded head such that the lower stop 421 is easy to be disengaged from the hole 31 of the first tube 30 by pushing the second tube 40 downwardly.

The present invention has an advantage that a manufacturer can choose a suitable length of the base element 501 to dispose the base element 501 to the suitcases with different sizes. The present invention has yet another advantage that the spring 44 provides an upward force after the handle 10 is pushed downward and the upper stop 411 is disengaged from the hole 31 of the first tube 30.

Although the invention has been explained in relation to its preferred embodiment, it is to be understood that many other possible modifications and variations can be made without departing from the spirit and scope of the invention as hereinafter claimed.

I claim:

1. A retractable handle assembly of a wheeled suitcase and comprising:

a handle, said handle having two legs each joined at one end by a gripping portion to form an inverted U-shaped configuration, each of said two legs having an inclined end formed on a distal end thereof opposite said one end, a slot defined in each of said legs and at least one recess defined in an under side of said gripping portion of said handle;

a receiving element having two ends, a hole defined in each of said two ends thereof aligned with one of said legs, at least one stud extending upwardly from an upper portion of said receiving element and in alignment with said recess of said handle for a resilient element mounted to said stud and received in said recess;

said suitcase having a pair of first tubes, each one of said first tubes fixedly disposed to each of two sides of said suitcase, each of said two sides of said suitcase having one of a pair of nuts fixedly engaged to an upper portion of said suitcase and one of a pair of receiving cups fixedly disposed to a bottom portion of said suitcase, each of said nuts having an upper central hole defined therein and a lower central hole defined in a bottom portion thereof, said lower central hole having a larger diameter than that of said upper central hole so as to form a shoulder portion on an abutment of said two holes, each of said first tubes having a first end and a second end, said first end of each of said first tubes received in said lower central hole of a respective one of said nuts and abutting said shoulder portion of said respective nut and said second end of each of said first tubes fixedly received in a respective one of said receiving cups by a bolt extending through said respective receiving cup to engage against said second end of said respective first tube and, a hole defined in a periphery of each of said first tubes;

a pair of second tubes each having a first end and a second end and being dimensioned to be retractably received in a respective one of said first tubes, at least one upper hole defined in a periphery of each of said second tubes near said respective first end thereof which extends through said upper central hole of said respective nut and received in a respective one of said holes of said receiving element and each of said legs being inserted in said first end of said respective second tube, a pin extending through said receiving element, said first end of a respective one of said second tubes and said slot of a respective one of said legs; and said upper hole of each of said second tubes being in alignment with said hole of said respective first tube for an upper stop being inserted therethrough, said upper stop biased by an upper resilient element, said upper resilient element compressedly fixed in an inner periphery of each of said second tubes and having an inclined portion corresponding to said inclined end of said respective leg, each of said second tubes can be extracted out from said first end of said respective first tube by pushing said handle downward to push said inclined end of each of said legs to compress said inclined portion of said respective upper resilient element to disengage said upper stop from said hole of said respective first tube.

2. The retractable handle assembly as claimed in claim 1 wherein each of said second tubes has a lower hole defined in said periphery thereof and has a lower resilient element fixed in said inner periphery thereof to bias a lower stop inserted in said lower hole of each of said second tubes.

3. The retractable handle assembly as claimed in claim 1 wherein said second end of each of said second tubes has a block fixedly engaged therein by a pin extending therethrough, a spring fixedly engaged to each of said blocks with one end of said spring and the other end of said spring contacting said bottom of said suitcase and in a compressed state so as to provide an upward biasing force when said handle is pushed down and each of said upper stops is disengaged from said hole of said respective first tube.

* * * * *